US010094111B2

(12) United States Patent
LeVan

(10) Patent No.: US 10,094,111 B2
(45) Date of Patent: Oct. 9, 2018

(54) BUILDING FACADE SYSTEM

(71) Applicant: Kurtis E. LeVan, Munster, IN (US)

(72) Inventor: Kurtis E. LeVan, Munster, IN (US)

( * ) Notice: Subject to any disclaimer, the term of this patent is extended or adjusted under 35 U.S.C. 154(b) by 0 days.

(21) Appl. No.: 15/694,773

(22) Filed: Sep. 2, 2017

(65) Prior Publication Data

US 2017/0362826 A1 Dec. 21, 2017

Related U.S. Application Data

(63) Continuation of application No. 15/082,071, filed on Mar. 28, 2016, now Pat. No. 9,752,319.

(60) Provisional application No. 62/302,894, filed on Mar. 3, 2016.

(51) Int. Cl.

| | |
|---|---|
| ***E04H 1/00*** | (2006.01) |
| ***E04B 2/96*** | (2006.01) |
| ***E04B 2/88*** | (2006.01) |
| ***E04B 2/90*** | (2006.01) |

(52) U.S. Cl.

CPC ..... *E04B 2/967* (2013.01); *E04B 2/885* (2013.01); *E04B 2/90* (2013.01); *E04B 2/965* (2013.01)

(58) Field of Classification Search

CPC . E04B 2/967; E04B 2/965; E04B 2/90; E04B 2/885

USPC ..... 52/235, 236.3, 236.6, 264

See application file for complete search history.

(56) References Cited

U.S. PATENT DOCUMENTS

| | | | | |
|---|---|---|---|---|
| 2,885,040 | A | 5/1959 | Grossman | |
| 2,960,195 | A | 11/1960 | Toth | |
| 2,976,970 | A | 3/1961 | Toney | |
| 3,038,568 | A | 6/1962 | Morgan | |
| 3,052,330 | A * | 9/1962 | Hammitt | E04B 2/96 52/235 |
| 3,205,630 | A | 9/1965 | Felix et al. | |
| 3,246,441 | A | 4/1966 | Horgan, Jr. | |
| 3,315,426 | A * | 4/1967 | Rolland | E04B 2/90 292/115 |
| 3,439,601 | A | 4/1969 | Cooper | |
| 3,579,943 | A | 5/1971 | Tam | |
| 3,719,014 | A | 3/1973 | Sukolics | |
| 3,797,191 | A * | 3/1974 | Sukolics | E04B 2/76 52/204.62 |
| 3,936,986 | A | 2/1976 | Steel | |
| 4,055,923 | A | 11/1977 | Biebuyck | |
| 4,291,511 | A | 9/1981 | Stoakes | |
| 4,449,341 | A | 5/1984 | Taglianetti et al. | |

(Continued)

*Primary Examiner* — Brian E Glessner
*Assistant Examiner* — Joshua Ihezie
(74) *Attorney, Agent, or Firm* — George Pappas

(57) ABSTRACT

A building facade system includes framework having shelf members secured to the floor slabs. The top terminal ends of vertical mullions are fastened to the shelf members, thereby hanging the mullions therefrom. Horizontal support embers fastened to the mullions support infill panels and are coupled to shelf members which are on the below floor slab. Intermediate support members fastened to the mullions support slab edge cover panels. Posts are fastened to the shelf members and are secured to the floor slabs within troughs formed with embedded channels. The posts are horizontally and vertically adjustably fastenable to the shelf members. The shelf members are thereby also horizontally and vertically adjustable relative to the floor slabs. Terminal edges of the floor slabs can project into mullion cutouts.

20 Claims, 12 Drawing Sheets

(56) References Cited

U.S. PATENT DOCUMENTS 4,561,228 A 12/1985 Kaminaga
4,614,069 A 9/1986 Tanikawa et al.
4,621,478 A * 11/1986 Phillips ..... E06B 3/9636 52/204.595
4,662,135 A 5/1987 Tanikawa et al.
4,662,136 A 5/1987 Tanikawa et al.
4,662,145 A 5/1987 Tanikawa et al.
4,738,065 A 4/1988 Crandell
4,899,508 A 2/1990 Biebuyck
4,918,897 A 4/1990 Luedtke
5,036,637 A 8/1991 Biebuyck
5,046,293 A 9/1991 Kajiura
5,048,257 A 9/1991 Luedtke
5,077,947 A 1/1992 Takeda
5,127,202 A 7/1992 Yokota et al.
5,154,029 A * 10/1992 Sturgeon ..... E04F 13/12 52/235
5,216,858 A 6/1993 Gilmour
5,253,459 A 10/1993 Parinas et al.
5,267,419 A 12/1993 Yokota et al.
5,309,689 A 5/1994 Croissant
5,323,577 A 6/1994 Whitmyer
5,355,645 A 10/1994 Farag
5,369,924 A 12/1994 Neudorf
5,381,637 A 1/1995 Farag
5,579,616 A 12/1996 Farag
5,822,935 A 10/1998 Mitchell et al.
5,839,236 A 11/1998 Frey
6,425,218 B1 7/2002 Doyon et al.
6,804,920 B2 * 10/2004 Hogan ..... E04B 2/96 52/204.5
6,857,233 B2 2/2005 Farag
7,424,793 B1 9/2008 Shriver
7,644,549 B2 * 1/2010 Speck ..... E04B 2/90 52/235
7,827,746 B2 11/2010 Speck
7,832,160 B2 11/2010 Farag
7,856,775 B2 12/2010 Stahl, Jr.
8,001,738 B2 8/2011 Ting
8,959,855 B2 * 2/2015 Evensen ..... E04B 2/90 52/204.593
8,991,121 B1 * 3/2015 Baker ..... E04B 2/90 52/235
2002/0129573 A1 * 9/2002 Biebuyck ..... E04B 2/96 52/235
2002/0144476 A1 10/2002 Mastelli
2002/0148178 A1 10/2002 Farag
2003/0033764 A1 * 2/2003 Ting ..... E04B 2/96 52/235
2004/0154249 A1 8/2004 Mastelli
2006/0185274 A1 8/2006 Merica
2006/0201084 A1 9/2006 Arias
2009/0199498 A1 8/2009 Ting
2010/0050547 A1 3/2010 Speck
2010/0148641 A1 * 6/2010 Ehmke ..... A47B 47/0041 312/100
2010/0186315 A1 * 7/2010 Tambakakis ..... E06B 3/5427 52/167.1
2014/0157699 A1 * 6/2014 Moeller ..... E04B 2/88 52/235
2015/0135615 A1 * 5/2015 Hogan ..... E04B 2/90 52/235

* cited by examiner

BUILDING FACADE SYSTEM

CROSS REFERENCE TO RELATED APPLICATIONS

This application is a continuation and claims priority under 35 U.S.C. 120 of co-pending U.S. patent application Ser. No. 15/082,071, filed on Mar. 28, 2016, which claims priority under 35 U.S.C. 119(e) of U.S. provisional patent application Ser. No. 62/302,894 filed on Mar. 3, 2016 entitled HORIZONTALLY SUPPORTED SHIMLESS POST ANCHORED CURTAIN WALL FACADE SYSTEM, the disclosures of which are hereby incorporated herein by reference.

BACKGROUND OF THE INVENTION

1. Field of the Invention

The present invention relates to the field of facade systems which form a curtain wall or shell around buildings. More particularly, the present invention relates to a facade system having framework supported on the building floor slabs and which is easily horizontally and vertically adjustable relative to the floor slabs.

2. Background

Building facade systems are known and are common. They form a curtain wall around buildings and protect the building from the elements. The curtain wall comprises a plurality of panels supported on a framework which is secured to the building. The panels can be made of various materials such as glass, stone, steel, aluminum, etc., and can be various sizes as needed or desired. The panels can also be insulated. Different types of panels can be used such as, for example, transparent glass between the floor slabs and opaque glass or stone along the building structural components.

The building facade framework is typically secured to the floor slabs. Prior framework secured to floor slabs are, for example, shown and described in Evensen et al. U.S. Pat. No. 8,959,855; Ting U.S. Pat. No. 8,001,738; Speck U.S. Pat. No. 7,644,549; and, Hogan et al. US 2015/0135615.

The prior building facade framework is, however, not readily adjustable to compensate for construction tolerances of the building floor slabs, are generally cumbersome and difficult to install and relatively costly.

Prior building framework is supported to the slab structure via vertical load carrying members secured to the slabs via large unsightly and obtrusive anchors from the ends of the verticals to the top and bottom of slabs. These anchors are either covered with large trim members or placed into recessed pockets that are difficult to coordinate and have to be later filled with concrete. This also leads to a large buildup of sightline to the interior, blocking the occupant's view of the outdoors and reducing available light to the interior.

The embedded anchor system for prior building framework is located well inwards of the façade due to the structural issues created by anchorage via vertical members as described above. These embedded anchors often conflict with the native placement of the steel reinforcing system for the building structure and concrete slabs, which often has to be modified at substantial cost.

Prior curtainwall system designs with vertical load carrying members require separate installations of firesafing insulation, reinforcing, and smoke sealant to prevent the transmission of fumes and smoke between floors. These items are very costly.

Prior curtainwall system designs with vertical load carrying members require special treatment and "plugging" of the continuous vertical members to eliminate the transmission of sound from one floor to the next.

Prior curtainwall system designs with vertical load carrying members require special shimming of the anchor brackets to the structure, thereby necessitating expensive and labor intensive shim placements. These shimmed systems are not readily adjustable.

These concerns have been addressed by "window wall" systems utilizing continuous head and sill receptors that provide horizontal breaks between the floors, but these require multiple layers of gaskets, sealant, shimming, and many additional assemblies, components, and installation operations to properly implement.

The above prior building framework methodologies considerably increase the material and labor costs associated with the enclosure of a building. Accordingly, a need exists for an improved building facade system.

SUMMARY OF THE INVENTION

The invention of the continuous horizontally supported and post anchored system as described herein eliminates the need for all of the above costly and labor intensive components of prior building façade designs and substantially reduces the cost of building enclosure. The present invention overcomes disadvantages of prior facade systems by providing a framework secured to the building floor slabs and which is easily horizontally and vertically adjustable. Accordingly, the position of the framework and the curtain wall panels supported thereof can be adjusted to compensate for building construction tolerances and, after construction has been completed, to also compensate for dissimilar building movements and floor slab deflections. The present invention advantageously does not require shims and spacers for installation of the framework. The present invention also allows for the curtain wall panels to be located relatively close to the terminal edges of the building floor slabs.

In one form thereof the present invention is directed to a building facade system including a shelf member supported on a building floor slab. Vertical mullions hang from the shelf member to a building level below the floor slab. A curtain panel is supported on the vertical mullions. Posts are fastened to the shelf member. The posts extend from the shelf member, are secured to the building floor slab and support the shelf member, whereby the shelf member, the vertical mullions and the curtain panel are supported on the floor slab.

Preferably, the curtain panel is supported on a support member extending between the vertical mullions and the support member is coupled to a second shelf member secured to a second floor slab below the building level. The curtain panel can be an infill panel located adjacent the building level and supported on the support member. The curtain panel can also include a slab edge cover panel located adjacent the building floor slab and supported on a second support member extending between the vertical mullions.

Also preferably, the shelf member includes a chicken head and the support member includes a receiving channel. The chicken head is slidably received in the receiving channel. A sill trim cover can be fastened to the support member and adapted to slide adjacent the shelf member.

The posts are preferably horizontally adjustably fastenable to the shelf member whereby the shelf member is horizontally adjustable relative to the building floor slab. In this regard, the posts can be threaded and the system further includes a slot in the shelf member. One of the threaded posts extends through the shelf member slot. A threaded nut and a support pad having a threaded hole are provided and the post threadingly engages and extends through the threaded nut and the support pad threaded hole. An area of the shelf member adjacent the slot is sandwiched between the threaded nut and the support pad. Accordingly, loosening the nut allows horizontal adjustment of the post within the slot and tightening the nut clamps the shelf member area between the nut and the support pad thereby fastening the post to the shelf member. Preferably, the shelf member includes serrations engageable with serrations on the support pad whereby, when the shelf member area is clamped between the nut and the support pad, the serrations are engaged and securely fasten the shelf member to the post.

The posts are also preferably vertically adjustably fastenable to the shelf member whereby the shelf member is vertically adjustable relative to the building floor slab. In this regard, the posts can be threaded and the system further includes an opening extending through the shelf member. One of the threaded posts extends through the shelf member opening. A threaded nut and a support pad having a threaded hole are provided and the post threadingly engages and extends through the threaded nut and the support pad threaded hole. An area of the shelf member adjacent the opening is sandwiched between the threaded nut and the support pad whereby loosening the nut allows vertical adjustment of the post within the opening and tightening the nut clamps the shelf member area between the nut and support pad thereby fastening the post to the shelf member. Preferably, the shelf member includes serrations engageable with serrations on the support pad whereby, when the serrations are engaged, the support pad is prevented from rotating about post.

A trough is preferably provided on the building floor slab and the post is secured in the trough. The trough is formed with a channel embedded in the building floor slab. If the building floor slab includes concrete, a stud can be secured to the channel and extend into the concrete.

Preferably, the vertical mullions each include a top terminal end and the shelf member is fastened to the mullions at their top terminal ends. The vertical mullions are preferably provided with cutouts and a terminal edge of the floor slab extends into the cutouts.

In another form thereof, the present invention is directed to a building facade system having a shelf member supported on a building floor slab. Vertical mullions hang from the shelf member to a building level below the floor slab. A curtain panel is supported on the vertical mullions. The vertical mullions each include a top terminal end and the shelf members are fastened to the mullions at their top terminal ends, whereby the shelf member, the vertical mullions and the infill panel are supported on the floor slab.

Preferably, the curtain panel is supported on a support member extending between the vertical mullions and the support member is coupled to a second shelf member secured to a second floor slab below the building level. The curtain panel can include an infill panel located adjacent the building level and supported on the support member. The curtain panel can further include a slab edge cover panel located adjacent the building floor slab and supported on a second support member extending between the vertical mullions.

Also preferably, the shelf member includes a chicken head and the support member includes a receiving channel, and the chicken head is slidably received in the receiving channel. A sill trim cover can be fastened to the support member and adapted to slide adjacent the shelf member. The vertical mullions can include cutouts wherein a terminal edge of the floor slab may extend.

BRIEF DESCRIPTION OF THE DRAWINGS

The above mentioned and other features and objects of this invention, and the manner of attaining them, will become more apparent and the invention itself will be better understood by reference to the following description of the embodiments of the invention taken in conjunction with the accompanying drawings, wherein.

Figure 1:
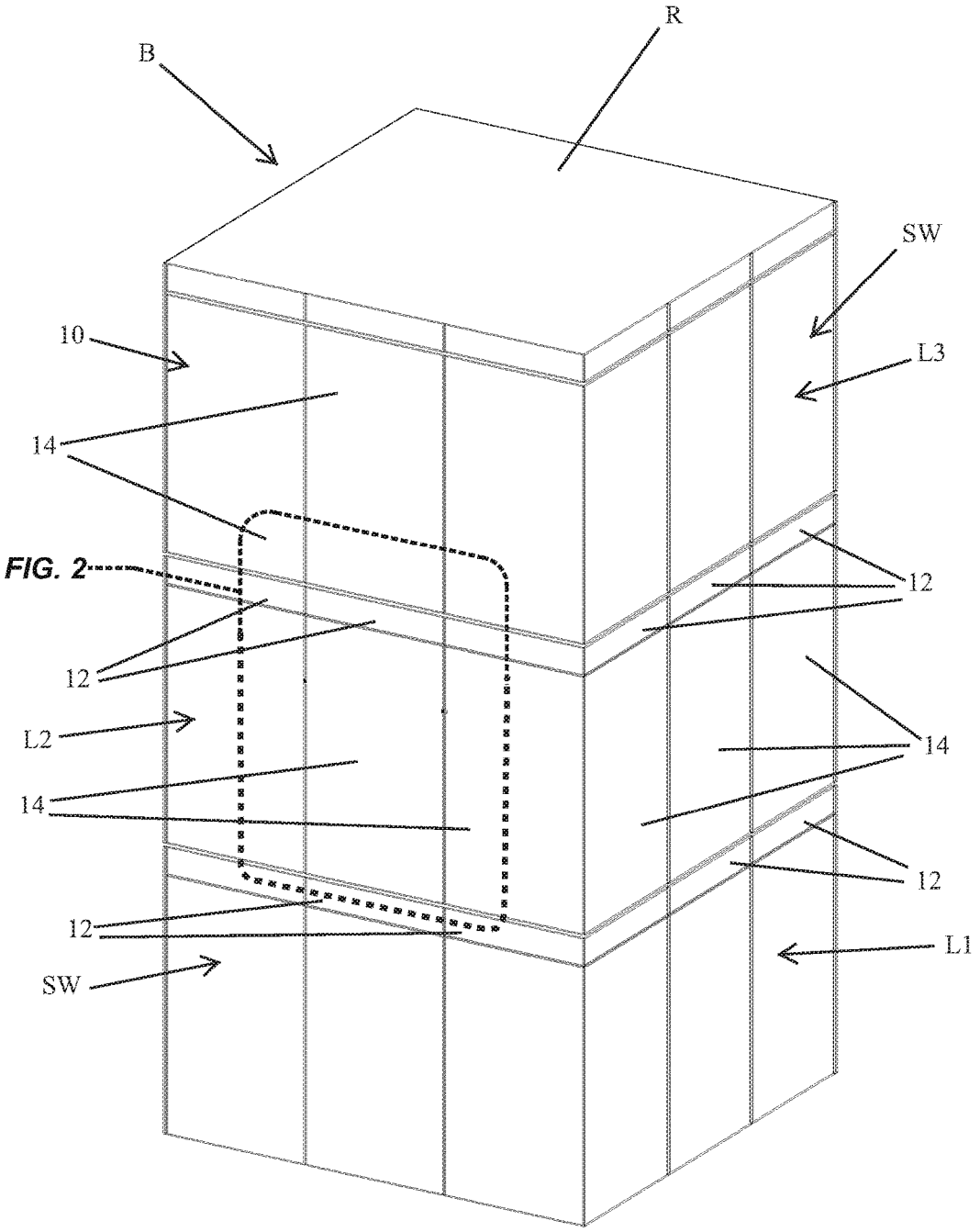
FIG. 1 is a diagrammatic perspective view of a facade system constructed in accordance with the principles of the present invention on a building.

Corresponding reference characters indicate corresponding parts throughout several views. Although the exemplification set out herein illustrates embodiments of the invention, in several forms, the embodiments disclosed below are not intended to be exhaustive or to be construed as limiting the scope of the invention to the precise forms disclosed.

DETAILED DESCRIPTION OF THE PREFERRED EMBODIMENTS

Referring initially to FIG. 1, a building facade system constructed in accordance with the principles of the present invention is generally designated by the numeral 10 and is shown installed on a building B. Building B includes a roof R and multiple side walls SW. Building B can, of course, include various shaped and any number of side walls SW and can comprise any number of floors or levels as needed or architecturally desired. Building B is diagrammatically depicted and is shown having three levels L1, L2 and L3. Concrete and/or steel and concrete floor slabs FS are constructed and supported between each of the levels L1, L2, L3 in a known and customary manner. The floor slabs FS each include a top surface TS, an underside surface US and a terminal edge surface ES. The terminal edge surfaces ES of each floor slab FS are generally coplanar with one another.

The facade system 10 is secured to the floor slabs FS and forms an outer curtain wall or shell which is architecturally aesthetically pleasing, and which protects the building from the elements. The curtain wall/shell is formed with a plurality of curtain panels which form the curtain wall/shell. The curtain panels can include a plurality of slab edge cover panels 12 extending along and generally covering the floor slab edge surfaces ES, and a plurality of infill panels 14 extending between the slab edge cover panels 12 and enclosing the building interior space at each level L1, L2, L3 generally between the successive floor slabs FS. The slab edge cover panels 12 and the infill panels 14 can be made of glass which can be transparent, opaque, tinted, translucent, etc. and/or stone, steel, aluminum and other materials as needed or desired and can, also, be insulated as needed or desired. The slab edge cover panels 12 and the infill panels 14 can also comprise many different dimensions, layers and thicknesses as needed or desired. The slab edge cover panels 12 and the infill panels 14 are supported on a framework 16 which is secured to the floor slabs FS as described herein below. The framework 16 consists of components preferably, in large part, made of extruded aluminum, although other materials can also be used such as painted or galvanized steel, wood, etc.

The infill panels 14 of the preferred embodiments, as shown in FIGS. 1, 3-6 and 10-13, comprise insulated glass panels 14G which are constructed in a known and customary manner and sized to fit within the framework 16. The insulated glass panels 14G shown comprise an exterior 0.25 inch thick glass pane 14E adhered to an interior 0.25 inch thick glass pane 14I along a sandwiched 0.50 inch spacer 14S extending along the perimeter thereof, although many other dimensions, layers and thickness can also be used as needed or desired. An insulating 0.50 thick air space 14A is thereby sealed and provided between the glass panes 14E, 14I.

The slab edge cover panels 12 shown in FIGS. 1-12 also comprise insulated glass panels 12G constructed in a known and customary manner and sized to fit within the framework 16. The insulated glass slab edge cover panels 12G shown are constructed similar to the infill insulated glass panel panels 14G with an exterior 0.25 inch thick glass pane 12E adhered to an interior 0.25 inch thick glass pane 12I along a sandwiched 0.50 inch spacer 12S extending along the perimeter thereof, although many other dimensions, layers and thickness can also be used as needed or desired. An insulating 0.50 thick air space 12A is thereby similarly sealed and provided between the glass panes 12E, 12I.

Figure 13:
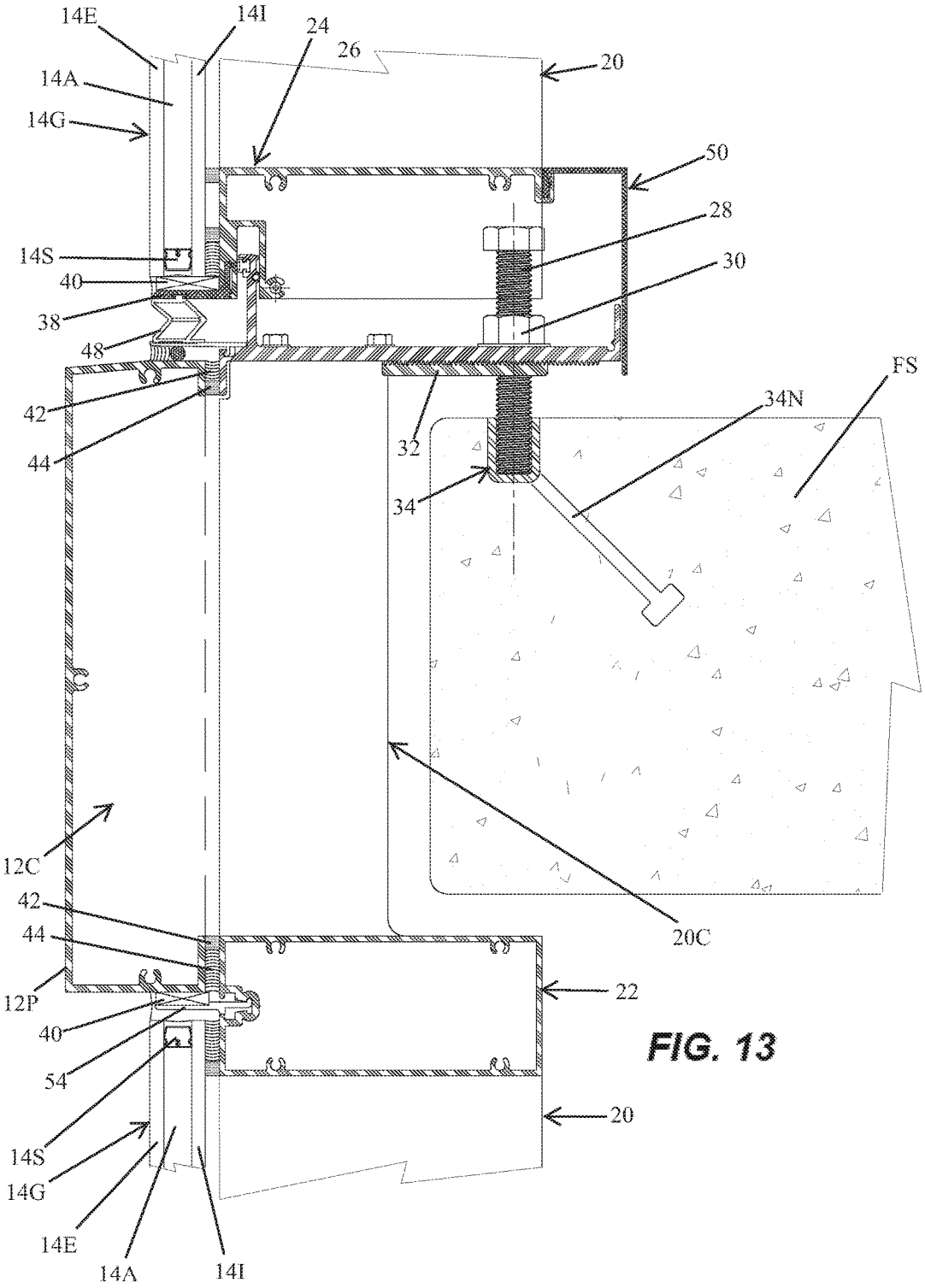

The slab edge cover panel 12 shown in FIG. 13 comprises a formed pan shaped cover panel 12P. The pan shaped cover panel 12P can be made by forming aluminum, steel or plastics. Insulation (not shown) can be provided within the pan cavity 12C as needed or desired. The pan shaped cover panels 12P protrude beyond the exterior face of the infill glass panels 14G and thereby provide a different architectural appearance.

Figure 2:
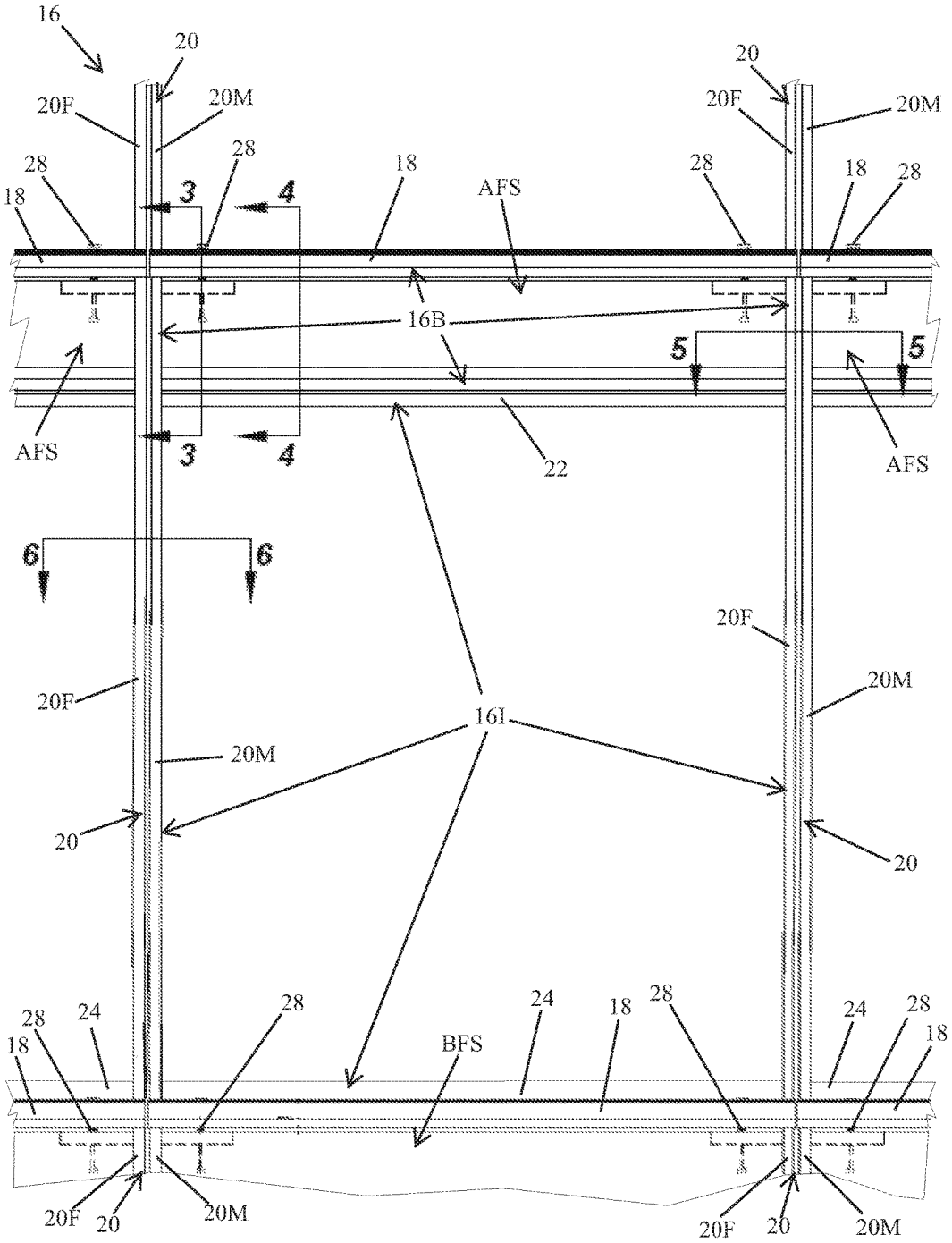
FIG. 2 is a partial side elevation view of the framework of the facade system shown in FIG. 1 and wherein the infill panels, the edge cover panels and the horizontal infill support members on the above floor slab have been removed for clarity.

The framework 16 functions to, for each building level L1, L2, L3, hang the infill panels 14 of that building level from the floor slab FS thereabove. For clarity and reference in this regard, as depicted in FIG. 2, for any level L1, L2, L3, the floor slab below and/or which supports that level is herein referred to as the "below" floor slab BFS, and the floor slab directly above that level is referred to as the "above" floor slab AFS. More particularly, the framework 16 includes horizontal shelf members 18 which are secured to the above floor slabs AFS at the top surfaces TS thereof. Vertical mullions 20 are securely fastened to the horizontal shelf members 18 located on the above floor slab AFS and extend vertically downwardly therefrom toward the below floor slab BFS. Horizontal infill support members 24 extend between and are securely fastened to the lower terminal ends of adjacent pairs of vertical mullions 20. The infill support members 24 are coupled to the horizontal shelf members 18 which are secured to the below floor slab BFS. The infill support members 24 and the horizontal shelf members 18 are coupled in a manner whereby they are movable vertically but not horizontally relative to each other.

Intermediate horizontal edge cover support members 22 are located vertically between the infill support members 24 and the shelf members 18, and extend between and are securely fastened to adjacent pairs of vertical mullions 20. Accordingly, a plurality of rectangular infill frames 16I are formed and defined between the adjacent pairs of vertical mullions 20, the infill support members 24 and the intermediate horizontal edge cover support members 22. The infill panels 14 are sized to fit within and be adhered to the rectangular infill frames 16I. More particularly, the infill panels 14 are supported on the infill support members 24 and are adhered along their perimeter edges to the adjacent pairs of vertical mullions 20, the infill support members 24 and the intermediate horizontal edge cover support members 22.

Similarly, a plurality of rectangular slab cover frames 16B are formed and defined between the adjacent pairs of vertical mullions 20, the intermediate horizontal edge cover support members 22 and the shelf members 18 on the above floor slab FS. The slab edge cover panels 12 are sized to fit within and be adhered to the rectangular slab cover frames 16B. More particularly, the slab edge cover panels 12 are supported on the intermediate horizontal edge cover support members 22 and are adhered along their perimeter edges to the adjacent pairs of vertical mullions 20, the intermediate horizontal edge cover support members 22 and the shelf members 18 on the above floor slab AFS.

As should now be appreciated, the weight of the infill panels 14 is transferred from the infill support members 24 to the vertical mullions 20. The weight of the slab edge cover panels 12 is transferred from the intermediate horizontal edge cover support members 22 also to the vertical unions 20. Hence, the infill panels 14 and the slab edge cover panels 12 are "hung" on the shelf members 18 on the above floor slab AFS with the vertical mullions 20, and the vertical mullions 20 are, therefore, in tension.

Figure 6:
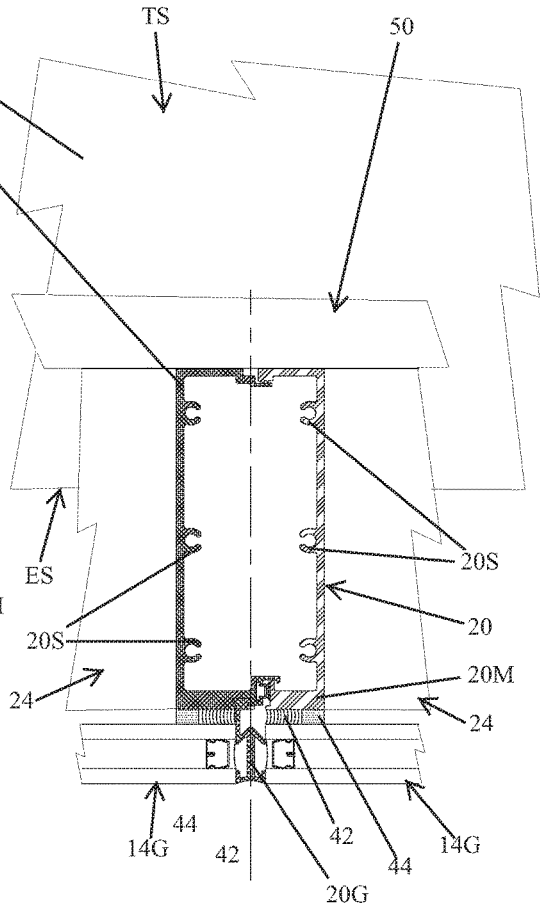
FIG. 6 is a cross sectional view of the facade system framework shown in FIG. 2 taken along line 6-6.

As best seen in FIG. 6, the vertical mullions 20 are rectangular shaped in cross section and comprise a female pan shaped half 20F and a male pan shaped half 20M. The male and female halves 20M, 20F securely snap together to form the rectangular shaped vertical mullions 20 in a known and customary manner. The mullion halves 20M, 20F include top terminal edges 20T and bottom terminal edges 20B. The distance between the top terminal edges 20T and the bottom terminal edges 20B and, hence, the length of the mullions 20 is slightly less than the distance between adjacent slab top surfaces TS. Screw splines 20S are integrally extruded/formed longitudinally along the inside surface of the mullion halves 20M, 20F and terminate at the top and bottom terminal edges 20T, 20B. The screw splines 20S are adapted to threadingly receive and engage fastener screws in a known and customary manner.

A mullion weather seal gasket 20G is secured longitudinally along the vertical mullion female half 20F and projects perpendicular therefrom. The weather seal gasket 20G is used between the infill panels 14 (FIG. 6) and also between the slab edge cover panels 12 (FIG. 5) to facilitate the thermal expansion and contraction thereof and to seal/prevent water entry therebehind.

Figure 3:
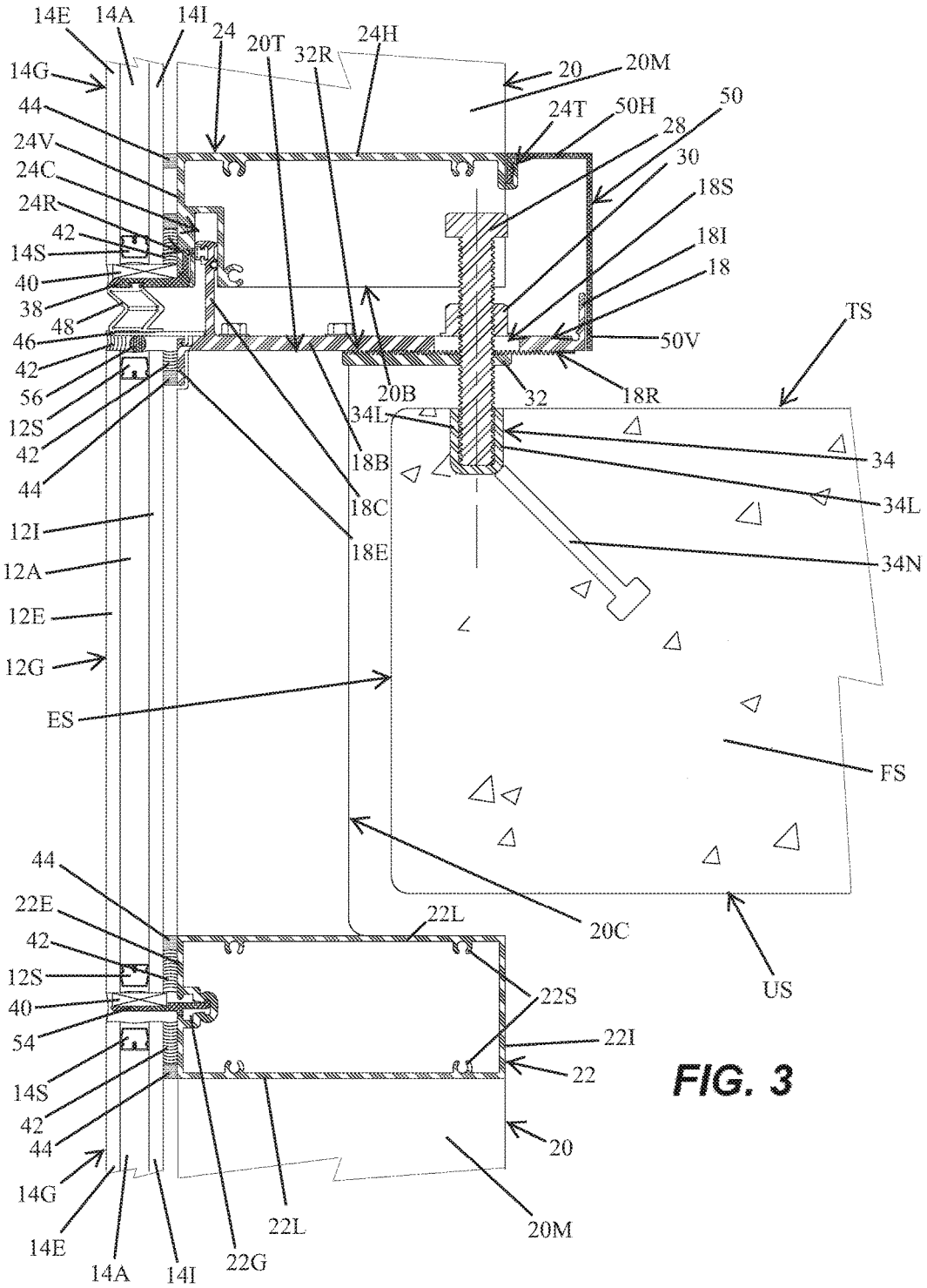
FIG. 3 is a cross sectional view of the facade system framework shown in FIG. 2 taken along line 3-3.
Figure 4:
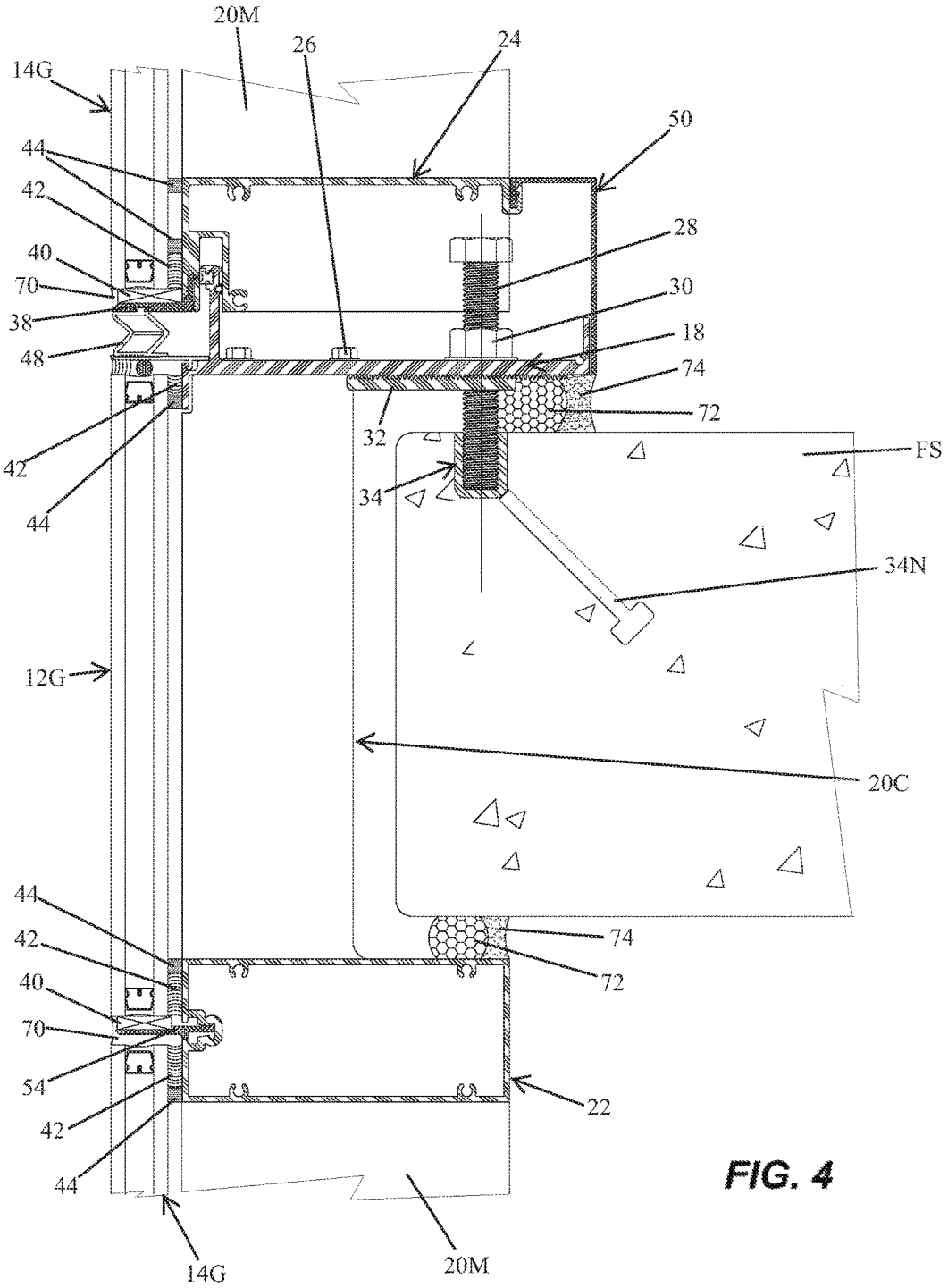
FIG. 4 is a cross sectional view of the facade system framework shown in FIG. 2 taken along line 4-4.
Figure 5:
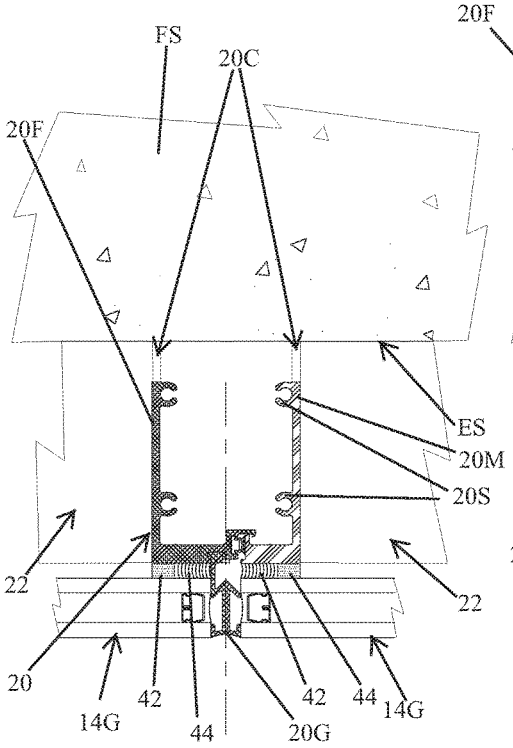
FIG. 5 is a cross sectional view of the facade system framework shown in FIG. 2 taken along line 5-5.
Figure 11:
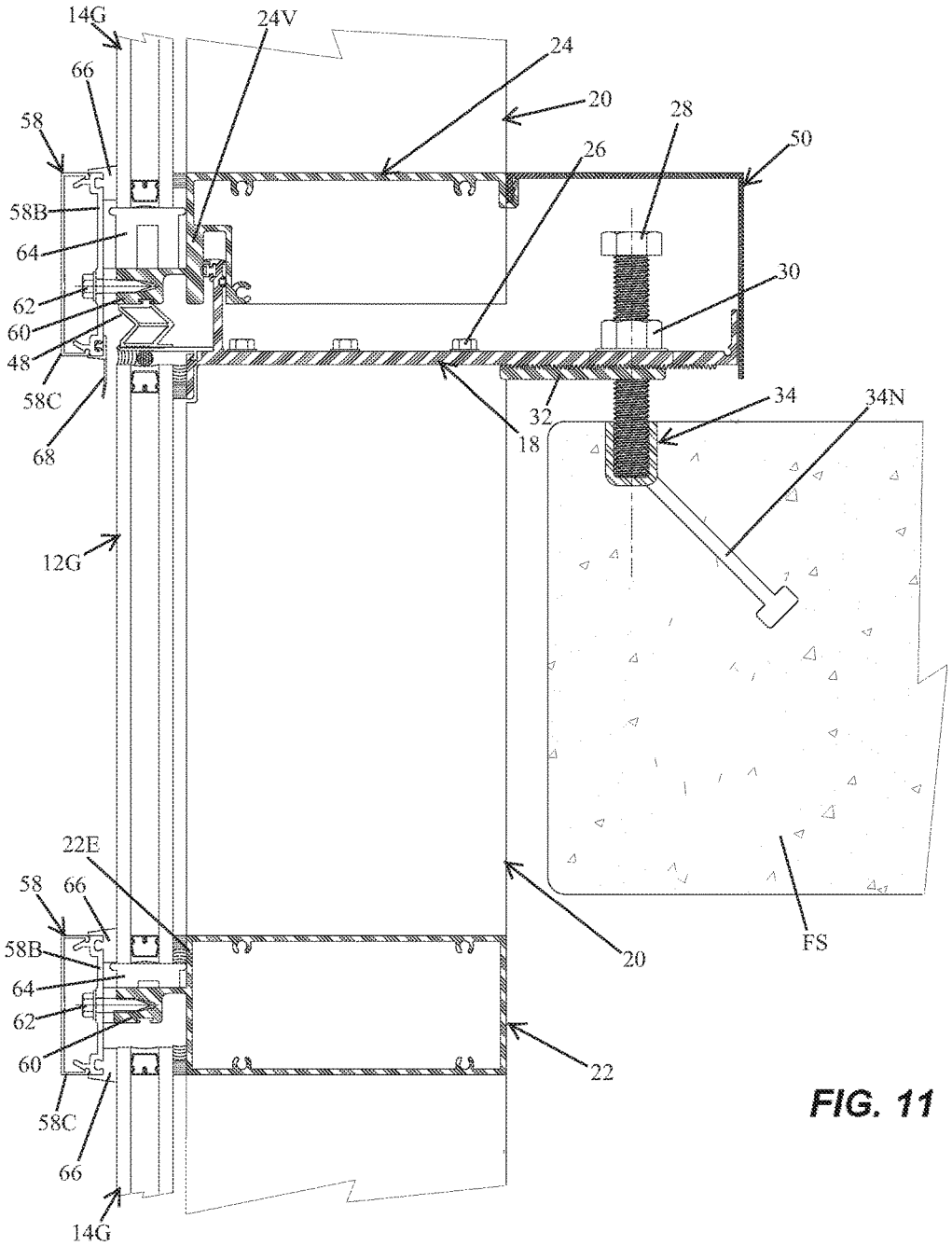
FIG. 11 is a cross sectional view similar to FIG. 4 but depicting an alternate embodiment comprising batten retainer strips along the panels edges and wherein the vertical mullions do not include a cutout for the slab terminal edges.
Figure 12:
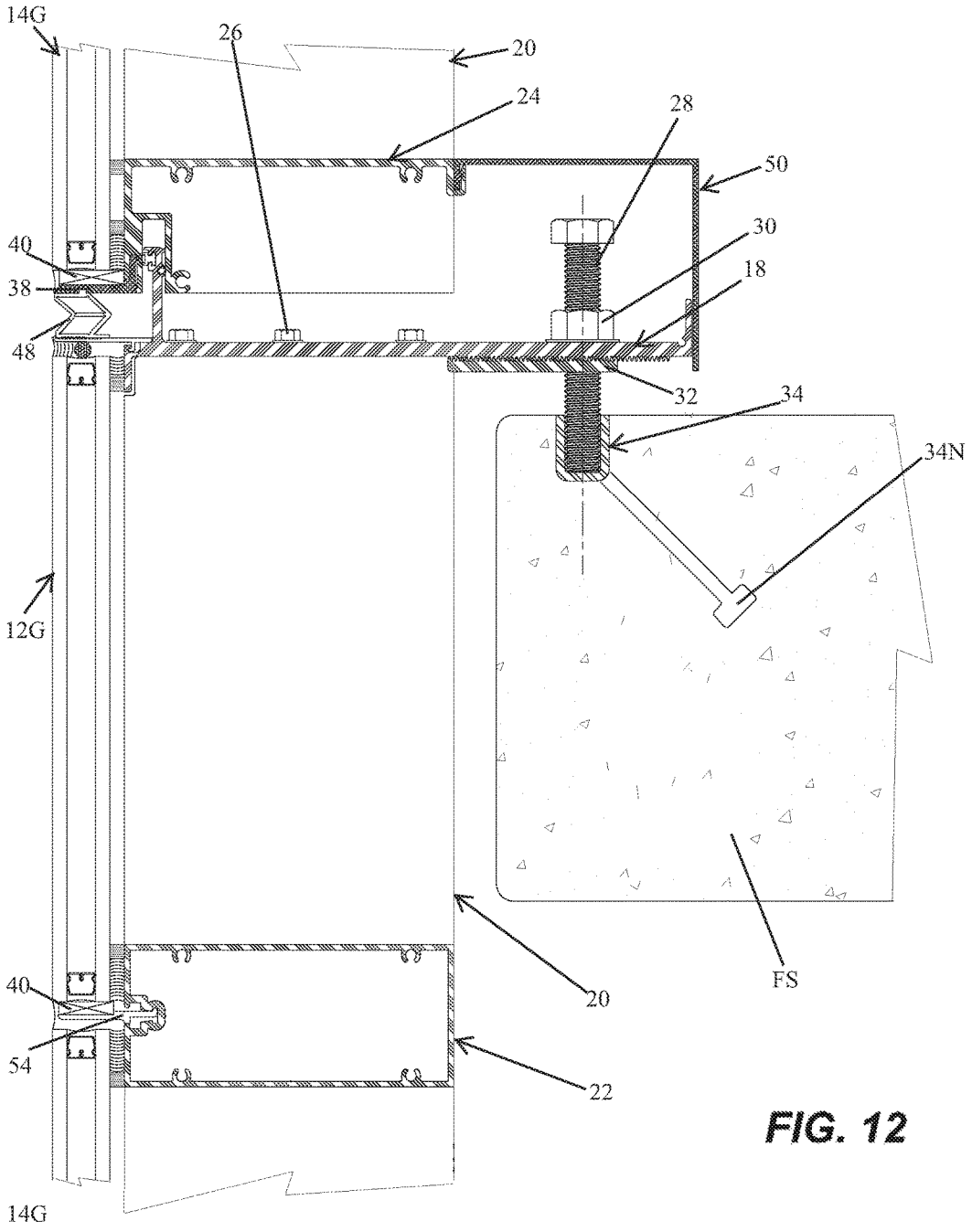
FIG. 12 is a cross sectional view similar to FIG. 4 but depicting another alternate embodiment wherein the vertical mullions do not include a cutout for the slab terminal edges; and, FIG. 13 is across sectional view similar to FIG. 4 but depicting yet another alternate embodiment comprising pan shaped edge cover panels protruding beyond the face of the panels.

An inside portion of the vertical mullion halves 20F, 20M can be milled or otherwise removed for thereby providing a cutout or notch 20C on the inside portion of the vertical mullions 20. As best seen in FIGS. 3, 4 and 5, the terminal part of the floor slab FS and the floor slab terminal edge surface ES project into and are received in the cutouts 20C. The cutouts 20C thereby, advantageously, allow the infill panels 14 and slab edge covers 12 to be located closer to the slab edge terminal surfaces ES. Alternatively, as shown in the embodiments of FIGS. 11 and 12, cutouts are not utilized and the vertical mullions 20 are located completely outside of and adjacent the floor slab terminal edge surfaces ES. In these embodiments, the infill panels 14 and the slab edge covers 12 are located a distance from the floor slab terminal edge surfaces ES which is generally equal to the width of the mullions 20 plus the width of the gap between the mullions 20 and the edge surfaces ES.

The shelf members 18 are preferably elongate extruded aluminum members which are cut to desired lengths. Shelf members 18 comprise a base plate 18B, a downturned exterior stop 18E, an upwardly extending interior stop 18I and a riser known as a "chicken head" 18C extending upwardly perpendicular from the base plate 18B. Serrations 18R are provided on the bottom face of the base plate 18B along the entire longitudinal length thereof. Slots 18S are milled or otherwise cut through the base plate 18B and extend perpendicular to the chicken head 18C and the exterior and interior stops 18E, 18I. Slots 18S are preferably about 9/16 inch wide and 2.0 inches long.

Holes 18H are provided at the terminal ends of the base plate 18B. The top terminal end of the mullions 20 are fastened to the shelf members 18 by abutting the mullion top edge 20T to the bottom face of the shelf member base plate 18, inserting the fastener screws 26 through the holes 18H, and threadingly securing the screws 26 into the mullion splines 20S.

Figure 8:
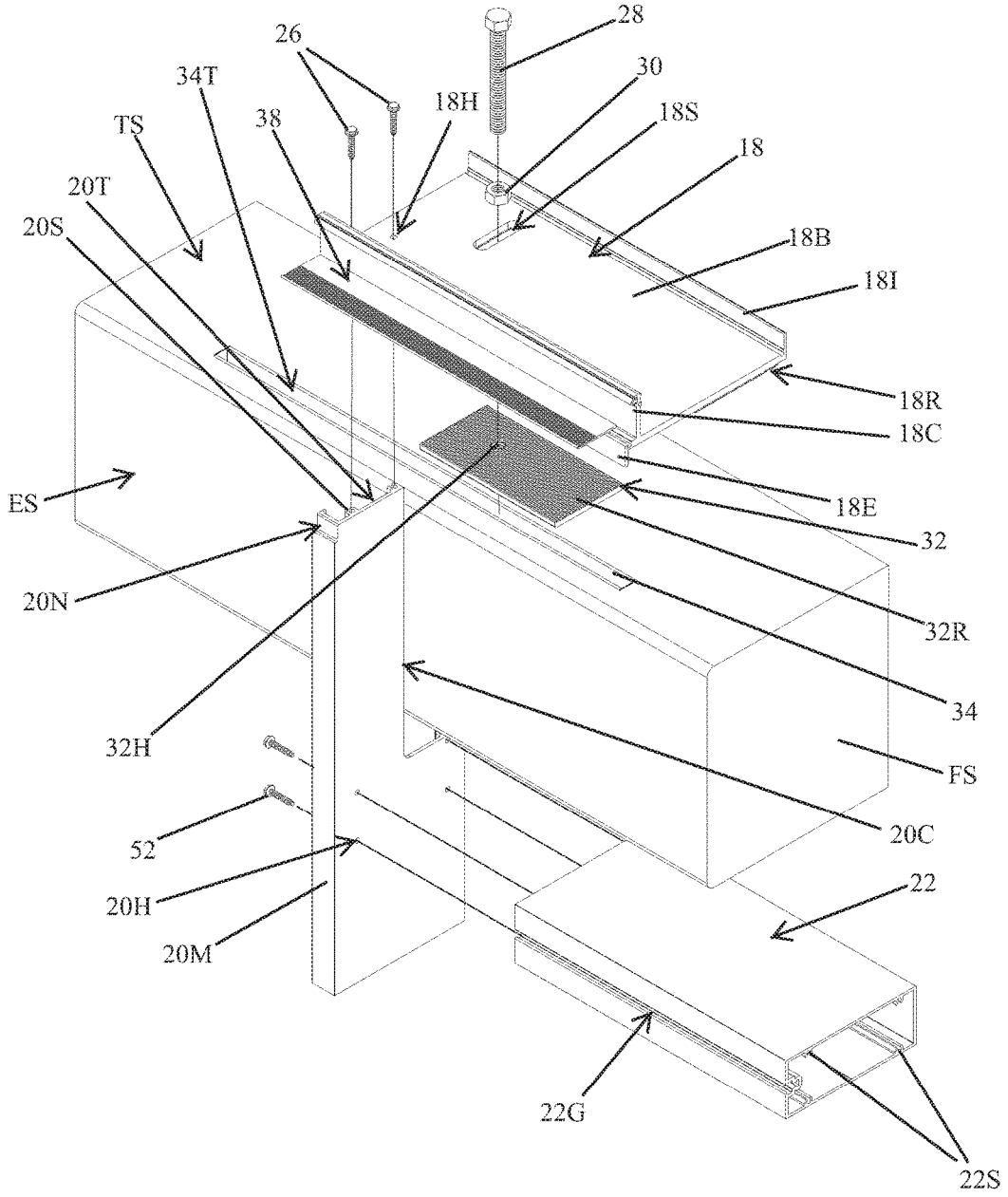
FIG. 8 is an exploded view of a horizontal shelf member, a male vertical mullion half and an intermediate horizontal edge cover support member, along with a support post and support pad used for horizontal and vertical adjustment, and further wherein the mullion includes a cutout for the slab terminal edge.

As best seen in FIGS. 3, 4 and 8, a notch 20N is milled or otherwise cut into the exterior face of the mullions 20. The notch 20N is milled into each mullion half 20F, 20M longitudinally along the exterior faces thereof downwardly from the top terminal edge 20T. As best seen in FIGS. 3 and 4, the shelf member exterior stop 18E is received within the mullion notch 20N. Accordingly, the exterior face of the mullions 20 and the exterior face of the shelf exterior stop 18E are aligned and are coplanar.

The shelf members 18 are secured to the above floor slabs AFS using cap screws or posts 28, locknuts 30, support pads 32 and sill retainer channels 34. In the embodiment shown the posts 28 are preferably 0.50 inch, 4.5 inch long hex head grade 8 cap screws. The locknuts 30 are preferably 0.50 inch serrated flange locknuts and are threadingly received on the posts 28. Of course, these dimensions are nominal and the length and width of the posts 28 can be varied as needed for supporting the dead loads, wind loads and other forces experienced by the framework 16 and the panels 12, 14 supported thereon. The posts 28 and locknuts 30 can also be made of other materials as needed and/or depending on the building construction requirements.

The support pads 32 are preferably extruded aluminum rectangular shaped plates. The top surface of the support pads 32 are provided with serrations 32R which are adapted to align and mate with the shelf member serrations 18R. Support pads 32 are provided with threaded holes 32H which are adapted to threadingly receive therethrough and engage the threaded posts 28. In the preferred embodiment, the holes 32H are 0.50 inch threaded holes.

The sill retainer channels 34 are preferably 11 gauge or thicker galvanized steel U-shaped channels having a depth of about 1.5 inches and a length of about 12 inches or as may be needed or desired. The interior clear width of the channels 34, between the channel legs 18L, is preferably about 0.52 inch so as to snugly receive and retain the posts 28 therein as best seen in FIGS. 3 and 4. The sill retainer channels 34 are embedded within the concrete floor slab FS with the terminal edges of its legs 34L located flush/aligned with the slab top surface TS. The sill retainer channels 34 thus open upwardly and create an elongate trough 34T which extends along the slab top surface TS and is parallel with the slab edge surface ES. Studs 34N which can be Nelson studs, headed steel, etc., are preferably welded to the channels 34 and extend at an angle therefrom into the floor slab FS for providing the channels 34 with additional structural strength as may be needed.

Referring again to FIGS. 3 and 4, the posts 28 are inserted through the shelf member slots 18S and extend downwardly into the trough 34T. The bottom terminal ends of the posts 28 extend to and rest on the bottom of the trough 34T. The locknuts 30 are threaded onto the posts 28 and are located above the shelf member base plate 18B. The support pads 32 are also threaded onto the posts 28 and are located below the shelf member base plate 18B. The base plates 18B are, hence, sandwiched between the locknuts 30 and the support pads 32. The weight of the shelf members 28 as well as the mullions 20 fastened to its terminal ends, etc. is, therefore, transferred to the support pads 32, and through the posts 28 to the embedded sill retainer channels 34.

By loosening the locknuts 30 and rotating the posts 28 clockwise or counterclockwise in the support pad threaded holes 32H, the posts 28 are selectively extended or retracted relative to the support pads 32. Hence, the support, pads 32 and the shelf members 18 thereon are selectively vertically movable/adjustable relative to the floor slab FS by merely engaging the head of the posts 28 and turning them about their longitudinal axis. The engagement of the support pad serrations 32R with the shelf member serrations 18R prevents the unwanted rotation of the support pads 32 as the posts are rotated and the shelf members 18 are adjusted vertically. More importantly, the engagement of the support pad serrations 32R with the shelf member serrations 18R serves to firmly and positively secure the shelf members 18 in the horizontal direction/perpendicular to the floor slab edge surface ES as described herein below.

For adjusting the shelf members 18 horizontally, the locknuts 30 are loosened, the shelf members 18 are lifted slightly for thereby separating/disengaging the shelf member serrations 18R from the support pad serrations 32R and the shelf members 18 are moved/adjusted horizontally as needed or desired. The maximum horizontal adjustment distance is equal to the length of the shelf member slots 18S less the diameter of the posts 28. In the preferred embodiment as shown, the maximum horizontal adjustment distance is about 1.5 inches or, if the posts 28 are initially centered within the slots 18S, about 0.75 inch horizontally in either direction. After the shelf members 18 are adjusted to the desired vertical height and the desired horizontal position, the locknuts 30 are tightened thereby clamping the shelf member base plates 18B between the lock nuts 30 and the support pads 32 and permanently locking the shelf members 18 thereat.

As should now be appreciated, the horizontal adjustability of the shelf members 18 allows for construction tolerances in the floor slabs FS for thereby maintaining the framework 16 and, hence, the infill panels 14 and slab edge cover panels 12 coplanar. The vertical adjustability of shelf members 18 allows for vertical adjustment of the vertical mullions 20 hanging therefrom along with the other components supported by the mullions 20 (the horizontal infill support members 24, the intermediate horizontal edge cover support members 22, the infill panels 14 and the slab edge cover panels 12) and for locating the horizontal infill support members 24 at a desired vertical height above the below floor slab BFS.

Figure 7:
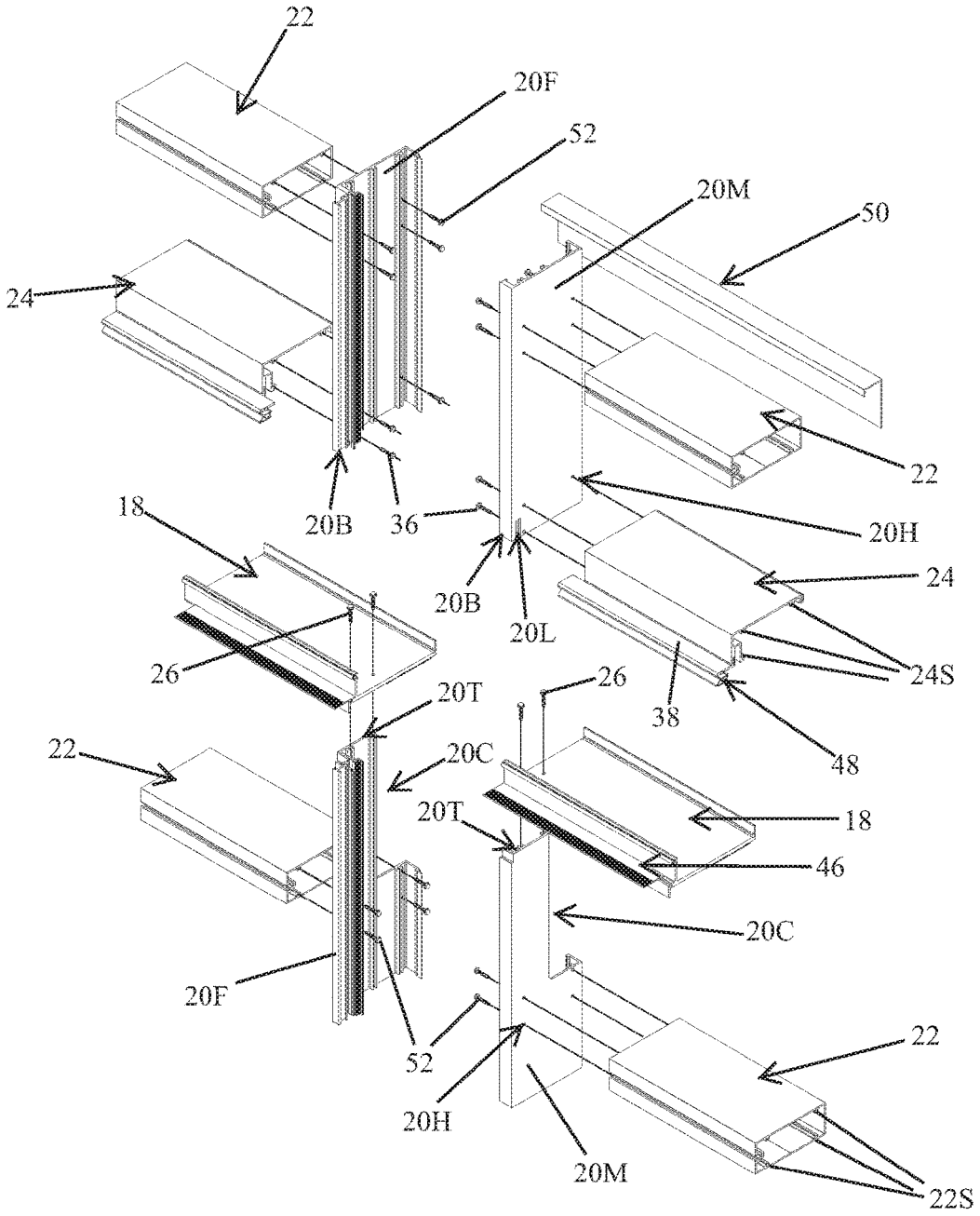
FIG. 7 is an exploded view of the horizontal shelf members, the vertical mullions and the intermediate horizontal edge cover support members constructed in accordance with the principles of the present invention.
Figure 9:
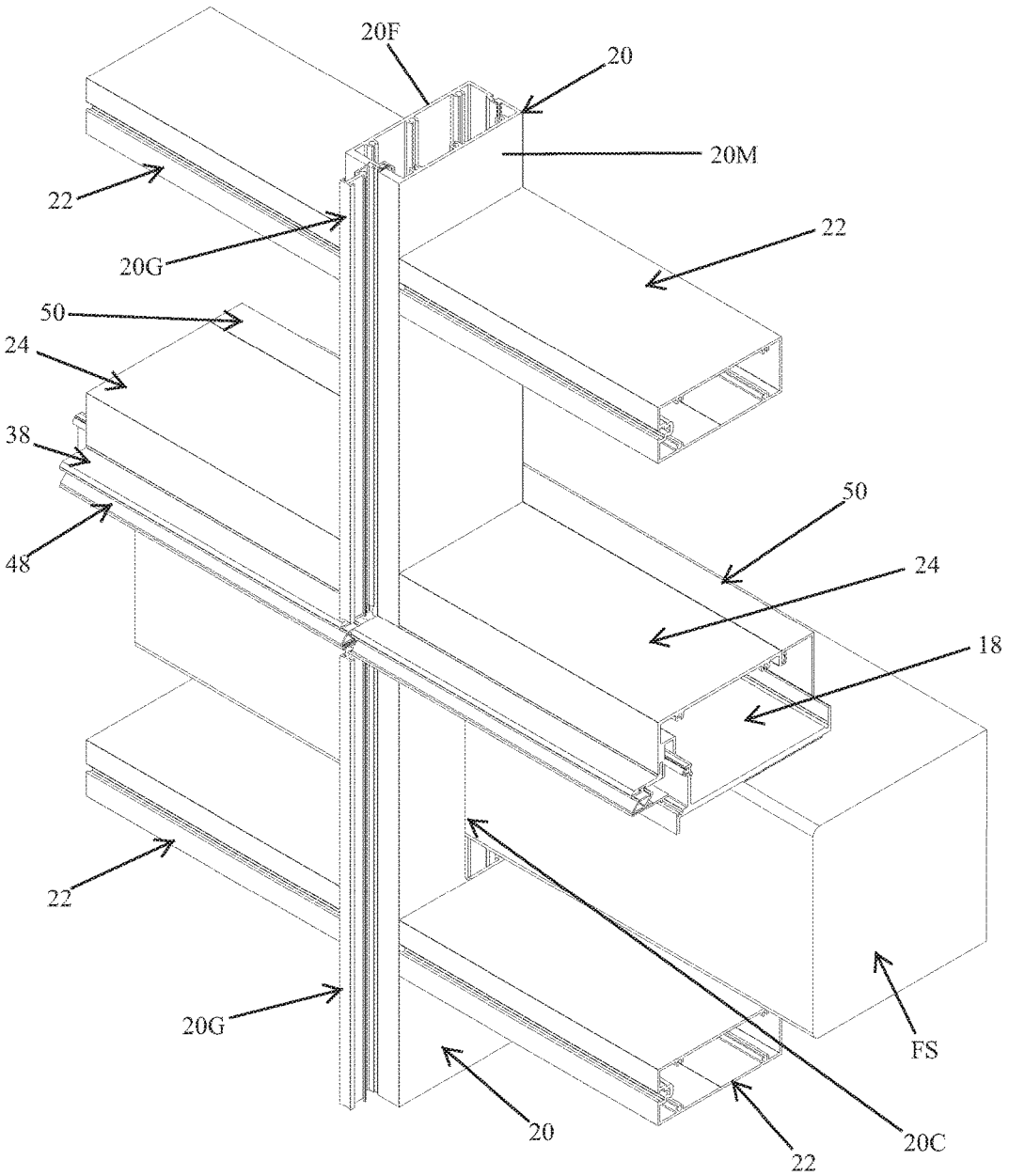
FIG. 9 is a perspective view of facade system components shown in FIG. 7 after they have been assembled.
Figure 10:
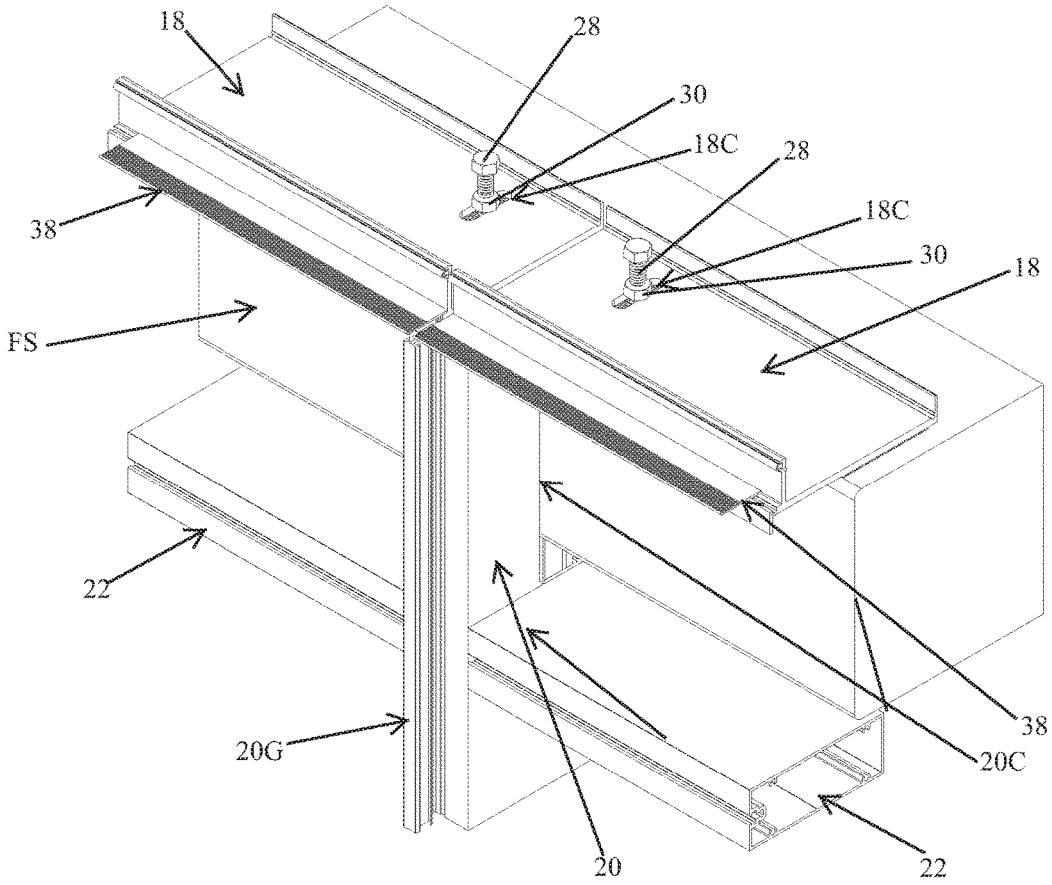
FIG. 10 is a perspective view of facade system components shown in FIG. 8 after they have been assembled and further showing a female vertical mullion half and a horizontal shelf member and edge cover support member fastened thereto.

The horizontal infill support members 24, as mentioned herein above, extend between and are securely fastened to the lower terminal ends of adjacent pairs of vertical mullions 20. Infill support members 24 are preferably elongate extruded aluminum members which are cut to desired lengths. Infill support members 24 are L-shaped having a vertical leg 24V and a horizontal leg 24H. A reglet/groove 24R which opens generally downwardly is formed in the vertical leg 24V. A chicken head receiving channel 24C is also formed in the vertical leg 24V and opens generally downwardly for receiving the shelf member chicken head 18C. Screw splines 24S are formed along the inside surfaces of the vertical and horizontal legs 24V, 24H and terminate at the terminal ends of the infill support members 24. As best seen in FIGS. 7 and 9, the horizontal infill support members 24 are fastened to the mullion halves 20F, 20M by abutting the terminal ends of the infill support members 24 to the side face of the mullion halves 20F, 20M, inserting fastener screws 36 through the mullion screw holes 20H, and threadingly securing the screws 36 into the support member screw splines 24S.

It is noted that chicken head receiving slots 24L are provided on the mullion halves 20F, 20M extending upwardly from the mullion bottom edges 20B. Chicken head receiving slots 24L are aligned with the infill support member chicken head receiving channels 24C and also receive the shelf member chicken head 18C therein.

The infill panels 14 are supported on the support members 24 with L-shaped edge support members 38 which attach/snap into the infill support member reglets 24R in a known and customary manner. Setting blocks 40 are provided between the support members 38 and the infill panels 14. The infill panels 14 are adhered to the support member vertical legs 24V, as well as the mullions 20 and the intermediate horizontal edge cover support members 22, with a two part structural sealant 42 and foam spacer structural tape 44, also in a known and customary manner.

A continuous top glass edge protector shelf 46 is fastened to the shelf members 18, in a known and customary manner, at the base of the chicken head 18C and above the downturned exterior stop 18E. Shelf 46 is generally coplanar with the shelf member base plate 18B. A flexible silicone weatherseal gasket 48 is provided between the edge support members 38 and the shelf 46. Gasket 48 facilitates thermal expansion and contraction and seals/prevents water entry therebehind.

Continuous L-shaped sill trim covers 50 are secured to the infill support members 24 for closing off easy access to the posts 28 and locknuts 30. In this regard, a sill trim cover attachment channel 24T is formed along the terminal edge of the horizontal legs 24H, and the horizontal leg 50H of the covers 50 attaches/snaps into the attachment channels 24T. The vertical leg 50V of the covers 50 extends adjacent to but is not attached to the shelf member upwardly extending interior stop 18I.

As should now be appreciated, thermal vertical expansion and contraction of the mullions 20, infill panels 14 and slab edge cover panels 12 hanging from an above floor slab AFS causes the horizontal infill support members 24 thereof to move vertically up and down relative to the shelf members 18 on the below floor slab BFS. As best seen in FIGS. 3 and 4, this vertical movement is facilitated by the shelf member chicken heads 18C sliding within support member chicken head receiving channels 24C, the sill trim cover vertical legs 50V sliding along the shelf member upwardly extending interior stops 18I, and the expansion and contraction of the weatherseal gasket 48. However, horizontal movement of the infill support members 24 is prevented by the horizontally fixed shelf member chicken heads 18C which are snugly received within the infill support member chicken head receiving channels 24C.

The intermediate horizontal edge cover support members 22, as mentioned herein above, extend between and are securely fastened to adjacent pairs of vertical mullions 20, between the shelf members 18 on the above floor slab AFS and the infill support members 24 adjacent the below floor slab BFS. In the preferred embodiments as shown, the edge cover support members 22 are adjacent the slab underside surfaces US. Of course, more than one intermediate horizontal edge support members 22 can be provided between adjacent mullion halves 20F, 20M as may be needed or desired for thereby supporting multiple separate infill panels 14, in addition to the slab edge cover panels 12. Edge cover support members 22 are preferably elongate extruded aluminum members which are cut to desired lengths. Edge cover support members 22 are rectangular shaped in cross section having long side walls 22L, and short interior walls 22I and exterior walls 22E.

Screw splines 22S are formed along the inside surfaces of the long side walls 22L and terminate at the terminal ends of the edge cover support members 22. As best seen in FIGS. 7 and 9, the edge cover support members 22 are fastened to the mullion halves 20F, 20M by abutting the terminal ends of the edge cover support members 22 to the side face of the mullion halves 20F, 20M, inserting fastener screws 52 through the mullion screw holes 20H, and threadingly securing the screws 52 into the edge cover screw splines 22S.

Attachment grooves 22G are provided along the edge cover support member exterior walls 22E wherein planar edge support members 54 are received and are snap fastened in a known and customary manner. The slab edge cover panels 12 are supported on the edge support members 54. Setting blocks 40 are provided between the support members 54 and the slab edge cover panels 12. The slab edge cover panels 12 are adhered to the intermediate horizontal edge cover support member exterior side walls 22E, as well as the mullions 20 and the shelf member downturned exterior stops 18E (or other intermediate horizontal edge cover support member exterior side walls 22E if multiple edge cover support members 22 are used), with a two part structural sealant 42 and foam spacer structural tape 44, also in a known and customary manner.

A foam backer rod 56 and silicone sealant 42 is provided between the upper edges of the slab edge cover panels 12 and the top glass edge protector shelf 46 also in a known and customary manner.

In the embodiment of FIG. 11 a two part batten retainer strip 58 is used along the perimeter edges of the infill panels 14 and other infill panels 14 and/or slab edge cover panels 12. The batten retainer strips 58 comprise base strips 58B which are adapted to be mechanically fastened. Batten covers 58C are adapted to attach/snap onto the base strips 58B. The horizontal infill support members 24 are provided with continuous integrally formed shelf strips 60 projecting perpendicularly from the support member vertical legs 24V. The intermediate horizontal edge cover support members 22 are similarly provided with continuous integrally formed shelf strips 60 projecting perpendicularly from their exterior side walls 22L. The shelf strips 60 function similar to the L-shaped edge support members 38 and the planar edge support members 54 to support the infill panels 14 and the slab edge cover panels 12. Shelf strips 60 are, however, thicker and are adapted to threadingly affix fastener screws 62 thereto. Accordingly, the batten base strips 58B are fastened to the shelf strips 60 with screws 62. The batten covers 58C are then attached/snapped onto the base strips 58B covering the fastener screws 62.

Continuous gaskets 66 can be used at the upper and/or lower interfaces between the batten base strips 58B and the infill panels 14 and/or the slab edge cover panels 12 to provide a seal and prevent water entry therebehind. Alternatively, a drip edge 68 can be used at the lower interface between the batten base strips 58B and the infill panels 14 and/or the slab edge cover panels 12.

Crown shaped setting blocks 64 having different heights/widths can be provided between the shelf strips 60 and the infill panels 14 and the slab edge cover panels 12 thereabove so as to thereby locate the infill panels 14 and the slab edge cover panels 12 at a desired vertical position.

Finally, as shown only in FIG. 4 for clarity, but representative of all embodiments, a silicone sealer 70 is applied between the infill panels 14 and/or the slab edge cover panels 12 as needed or desired. Also, so as to seal off between the building levels L1, L2, L3, a foam backer rod 72 and silicone sealer 74 are provided between the floor stab top surfaces TS and the shelf members 18 as well as between the floor slab underside surfaces US and the intermediate horizontal edge cover support members 22.

While this invention has been described as having an exemplary design, the present invention may be further modified within the spirit and scope of this disclosure. This application is therefore intended to cover any variations, uses, or adaptations of the invention using its general principles.

What is claimed is:

1. A building facade system comprising:

a shelf member extending horizontally along and directly supported on a first building floor slab, the shelf member having left and right terminal ends;

a pair of vertical mullions, wherein each mullion comprises a top terminal end and a bottom terminal end;

wherein the top terminal end of one of said vertical mullions is fastened to said left terminal end of said shelf member and the top terminal end of the other one of said vertical mullions is fastened to said right terminal end of said shelf member;

wherein each said vertical mullion thereby hangs from said shelf member with its bottom terminal end adjacent a second building floor slab below said first floor slab, and wherein each said vertical mullion is not directly connected to said first floor slab;

a curtain panel supported by said vertical mullions; and, wherein said shelf member, said vertical mullions and said curtain panel are supported by said first floor slab.

2. The building facade system of claim 1 wherein said mullion top terminal ends are fastened to said respective left and right shelf member terminal ends with fasteners extending through said shelf member terminal ends and said mullions top terminal ends.

3. The building facade system of claim 2 wherein said mullion top terminal ends are provided with screw splines and said fasteners are screws extending vertically through holes in said shelf member terminal ends and into said screw splines.

4. The building facade system of claim 2 wherein said fasteners are screws extending vertically through holes in said shelf member terminal ends and into said mullions top terminal ends.

5. The building facade system of claim 2 wherein said curtain panel is supported on a support member extending between said vertical mullions and wherein said support member is coupled to a second shelf member secured to said second floor slab.

6. The building facade system of claim 5 wherein said curtain panel comprises an infill panel located between said first and second building floor slabs and supported on said support member.

7. The building facade system of claim 6 wherein said curtain panel further comprises a slab edge cover panel located adjacent said first building floor slab and supported on a second support member extending between said vertical mullions.

8. The building facade system of claim 5 wherein said second shelf member comprises a chicken head and said support member comprises a receiving channel, and wherein said chicken head is slidably received in said receiving channel.

9. The building facade system of claim 5 further comprising a sill trim cover fastened to said support member and adapted to slide adjacent said second shelf member.

10. The building facade system of claim 2 wherein said curtain panel comprises an infill panel located between said first and second building floor slabs.

11. The building facade system of claim 10 wherein said curtain panel further comprises a slab edge cover panel located adjacent said first building floor slab.

12. The building facade system of claim 2 wherein said vertical mullions comprise cutouts and wherein a terminal edge of said first floor slab extends into said cutouts.

13. The building facade system of claim 1 wherein said curtain panel comprises an infill panel located between said first and second building floor slabs.

14. The building facade system of claim 13 wherein said curtain panel further comprises a slab edge cover panel located adjacent said first building floor slab.

15. The building facade system of claim 1 wherein said curtain panel is supported on a support member extending between said vertical mullions and wherein said support member is coupled to a second shelf member secured to said second floor slab.

16. The building facade system of claim 15 wherein said curtain panel comprises an infill panel located between said first and second building floor slabs and supported on said support member.

17. The building facade system of claim 16 wherein said curtain panel further comprises a slab edge cover panel located adjacent said first building floor slab and supported on a second support member extending between said vertical mullions.

18. The building facade system of claim 15 wherein said second shelf member comprises a chicken head and said support member comprises a receiving channel, and wherein said chicken head is slidably received in said receiving channel.

19. The building facade system of claim 15 further comprising a sill trim cover fastened to said support member and adapted to slide adjacent said second shelf member.

20. The building facade system of claim 1 wherein said vertical mullions comprise cutouts and wherein a terminal edge of said first floor slab extends into said cutouts.

* * * * *